United States Patent [19]

Böder

[11] Patent Number: 4,873,416

[45] Date of Patent: Oct. 10, 1989

[54] METHOD FOR THE APPLICATION AND FASTENING OF ROTATING BANDS ON PROJECTILE BODIES

[75] Inventor: Dieter Böder, Düsseldorf, Fed. Rep. of Germany

[73] Assignee: Rheinmetall GmbH, Düsseldorf, Fed. Rep. of Germany

[21] Appl. No.: 105,954

[22] Filed: Sep. 28, 1987

[51] Int. Cl.[4] ..... B23K 26/00

[52] U.S. Cl. ..... 219/121.64; 219/121.14

[58] Field of Search ..... 219/121 LC, 121 LD, 219/121 EC, 121 ED, 121 PJ, 121 PK

[56] References Cited

U.S. PATENT DOCUMENTS 3,952,180 4/1976 Gnanamuthu ..... 219/121 LD X 4,468,552 8/1984 Morley ..... 219/121 EC

*Primary Examiner*—C. L. Albritton

*Attorney, Agent, or Firm*—Spencer & Frank

[57] ABSTRACT

A method for the application of rotating bands on a projectile body comprises winding at least one layer of a first ribbon-like material around the projectile body; fastening the ribbon-like material on the projectile body by applying a laser or electron beam in a deep-penetration welding process; and giving the beam an intensity so that only a small zone near the surface of the projectile body is melted to the ribbon-like material.

12 Claims, 3 Drawing Sheets

METHOD FOR THE APPLICATION AND FASTENING OF ROTATING BANDS ON PROJECTILE BODIES

BACKGROUND OF THE INVENTION

1. Field of the Invention

The invention relates to a method for applying and fastening rotating bands on projectile bodies.

2. Discussion of the Prior Art

The application of rotating bands on projectile bodies is known, for example, from the book by Rheinmetall entitled "Waffentechnisches Taschenbuch" [Technical Ordinance Pocketbook], 7th Ed., 1985. As described there on page 526, the rotating bands are customarily manufactured from copper, copper alloys, soft iron, sintered iron or plastic and are usually pressed into a corresponding groove of the projectile body and finally turned down to the finished size. Such a method is disadvantageous in a very thin-walled projectile body because such a groove would weaken the projectile body so that the projectile body could burst when the projectile is fired.

SUMMARY OF THE INVENTION

It is therefore an object of the present invention to improve a method for applying and fastening rotating bands on a projectile body.

It is a further object of the present invention to provide a method for applying and fastening rotating bands on relatively thin-walled projectiles where there is usually no provision for the rotating band.

The above and other objects are accomplished, according to the invention, by a method for the application of rotating bands on a projectile body, which comprises winding at least one layer of a first ribbon-like material around the projectile body; fastening the ribbon-like material on the projectile body by applying a laser or electron beam in a deep-penetration welding process; and giving the beam an intensity shape so that only a small zone near the surface of the projectile body is melted to the ribbon-like material.

BRIEF DESCRIPTION OF THE DRAWINGS

The invention may be better understood by referring to the detailed description of the invention when taken in conjunction with the accompanying drawings in which.

DESCRIPTION OF THE PREFERRED EMBODIMENTS

Figure 1:
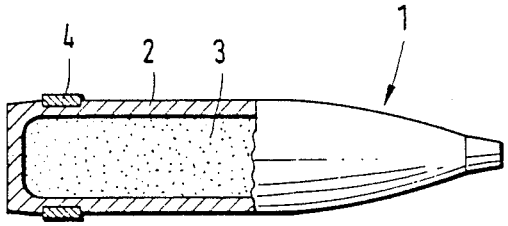
FIG.1 PRIOR ART
FIG. 1 is a partial sectional view of a prior art projectile having a rotating band.

A projectile 1 in FIG. 1 has a body 2. Inside the projectile body 2 is, for example, an explosive 3. A rotating band 4 is disposed in a groove on the aft end of the projectile 1.

It is often impossible to provide the projectile body 2 with grooves. Therefore in accordance with the present invention the rotating band is disposed on the projectile body and fastened on the projectile body 2 by means of laser beam or electron beam welding.

Figure 2:
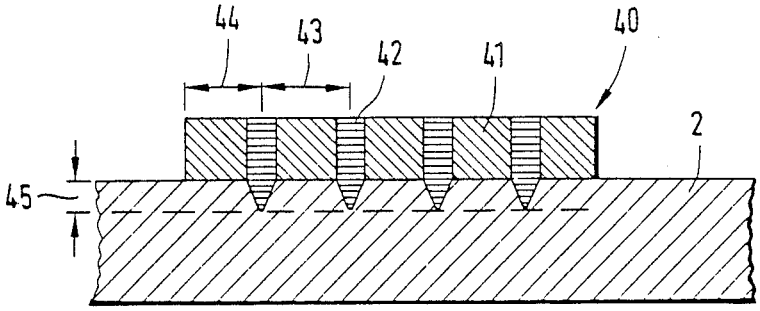
FIGS. 2 to 8 illustrate several embodiments of rotating bands applied to the projectile body shown by detailed sections.

A section of the aft end of the projectile body 2 on which a rotating band has been fastened, is shown in FIG. 2. The rotating band 40 mainly consists of a ribbon-like material 41. In the example shown, the ribbon-like material has been applied in a single layer to the projectile body 2 with as little clearance as possible. The electron beam then is directed from the outside through the rotating band into the body. The rotating band melts onto the body to the width of the pivoting electron beam. Because of the diminishing intensity of the beam along its axis, the appearance of the molten and then cooled body material is in the form of a triangular profile. This results in an optimal interconnection between the rotating band and the body. The molten zones are assigned the reference numeral 42 in FIG. 2.

This method is especially suited for the application of rotating bands onto thin-walled bodies because the thermal load on the body is extremely low. The rotating band can be applied to bodies without noticeable damage to its already heat-treated material. Number 43 in FIG. 2 means the distance between two parallel weldings. Number 44 is the distance of the first welding from the border of the rotating band.

However, it is important to select the intensity of the electron beam or the laser beam such that there is no melt-through of the body. The molten zone 42 can extend into an area 45 near the surface of the projectile body 2 to a depth of from 0.5 to 1 mm.

Figure 3:
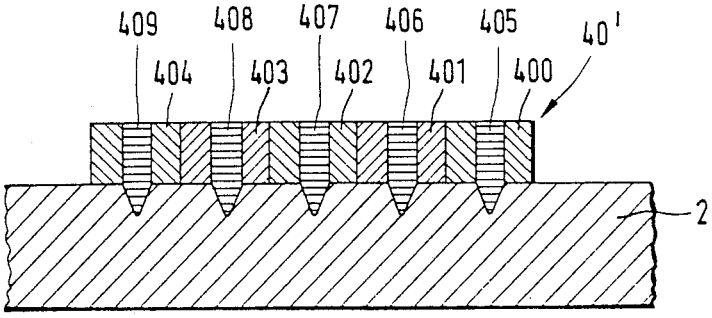

FIG. 3 shows a further example of a rotating band 40', in which narrow ribbon sections 400 to 404 are wound around the projectile body 2 either in the form of rings or spirals. This is again followed by electron beam or laser beam welding where the respective molten zones are designated as 405 to 409.

Figure 4:
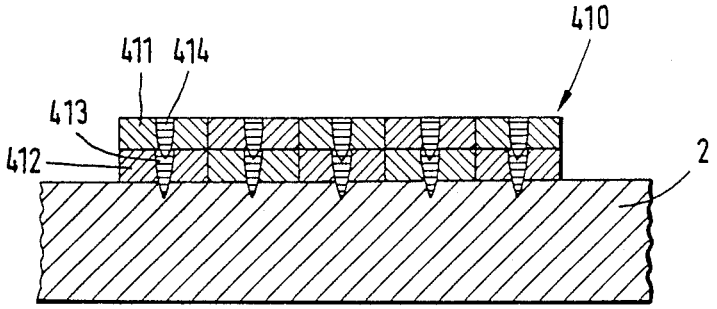

In FIG. 4 the rotating band 410 was manufactured by applying the narrow ribbon-like material in two layers on the body 2. The succeeding rotating band layer was welded onto the already welded rotating band layer. The first rotating layer is designated as 412, the second as 411 and the corresponding molten zones as 413 and 414.

Figure 5:
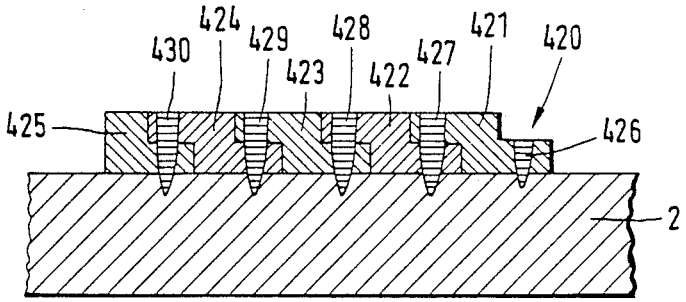
Figure 6:
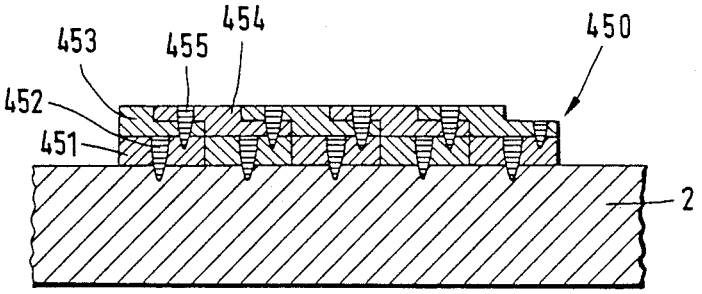

FIGS. 5 and 6 show welded rotating band layers in which the rotating bands are stepped. In FIG. 5 the rotating band is designated as 420, the several stepped band strips as 421 to 425 and the molten zones with 426 to 430. FIG. 6 shows a two-layered rotating band 450, the layer shown on the left edge is designated as 451, the corresponding molten zone as 452, the stepped layer on top of it as 453 and the layer following this stepped layer as 454. The layers 453 and 454 are fastened to the bottom layer 451 by means of the molten zone 455.

When using several layers it is of particular importance that only small bending forces be required for bending the ribbon-like material around the curvature of the outer surface of the body and that the band be only minimally plastically deformed during application.

Figure 7:
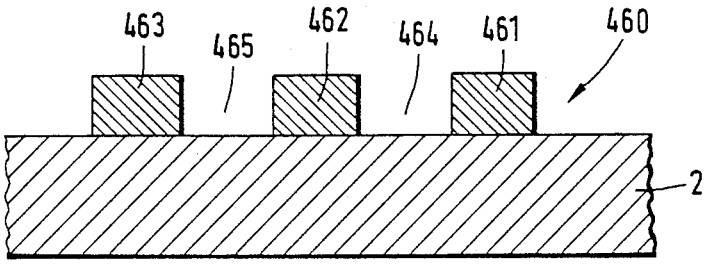
Figure 8:
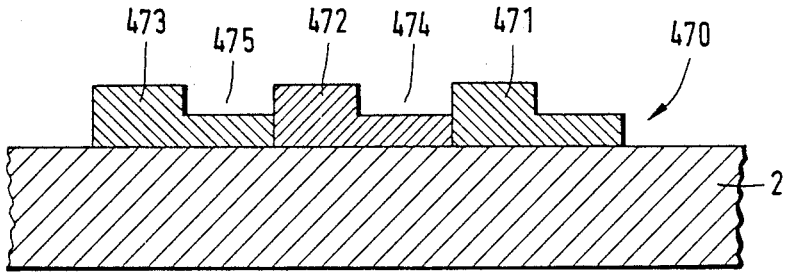

The use of narrow bands also permits the immediate creation of the finished outer diameter of the rotating band without mechanical finishing, since arching of the band is avoided. FIGS. 7 and 8 show it is possible to provide "grooves" in the rotating band by leaving recesses into which the material displaced by the lands of the rifled barrel during firing can flow. For simplicity, the molten zones are not shown in FIGS. 7 and 8.

The rotating band 460 in FIG. 7 consists of band segments 461, 462, 463 and the recesses 464 and 465. In FIG. 8 a stepped band material was used as rotating band 470. The steps are designated as 471, 472 and 473 and the recesses as 474 and 475.

One ribbon material is exemplary Iron with very low carbon content. The thickness of the ribbon-material is e. g. 3 mm. An exemplary of the electron beam is acceleration voltage: 120 kV
beam current: 8 mA
lens current: 233 mA
oscillation frequency: 1 kHz
weld speed: 10 mm/s The beam direction is normal to the ribbon surface.

The pivoting electron beam is guided on small circles (5 mm diameter) while the ribbon has a circumferencial speed along the projectile axis that means the weld speed.

It will be understood that the above description of the present invention is susceptible to various modifications, changes and adaptations, and the same are intended to be comprehended within the meaning and range of equivalents of the appended claims.

What is claimed is:

1. A method for the application of rotating bands on a projectile body comprising: winding at least one layer of a first ribbon-like material around the projectile body; fastening the ribbon-like material on the projectile body by applying a laser in a deep-penetration welding process; and giving the beam an intensity so that only a small zone near the surface of the projectile body is melted to the ribbon-like material.

2. A method according to claim 1, further comprising: applying the ribbon-like material in at least two layers and welding each layer to the preceding layer.

3. A method according to claim 1, wherein the ribbon-like material has a width and the rotating band has a width, the width of the ribbon-like material being narrower than the width of the rotating band; said step of winding being carried out so that the ribbon-like material is spirally wound around the projectile body.

4. A method according to claim 3, wherein the ribbon-like material is stepped.

5. A method according to claim 1, wherein said step of winding is carried out so that the ribbon-like material is wound around the projectile body in the form of a ring.

6. A method according to claim 1, wherein said step of winding is carried out so that the ribbon-like material is wound around the projectile leaving groove-like recesses between respective wound rotating band layers.

7. A method for the application of rotating bands on a projectile body comprising: winding at least one layer of a first ribbon-like material around the projectile body; fastening the ribbon-like material on the projectile body by applying an electron beam in a beam welding process; and giving the beam an intensity so that only a small zone near the surface of the projectile body is melted to the ribbon-like material.

8. A method according to claim 7, further comprising: applying the ribbon-like material in at least two layers and welding each layer to the preceding layer.

9. A method according to claim 7, wherein the ribbon-like material has a width and the rotating band has a width, the width of the ribbon-like material being narrower than the width of the rotating band; said step of winding being carried out so that the ribbon-like material is spirally wound around the projectile body.

10. A method according to claim 9, wherein the ribbon-like material is stepped.

11. A method according to claim 7, wherein said step of winding is carried out so that the ribbon-like material is wound around the projectile body in the form of a ring.

12. A method according to claim 7, wherein said step of winding is carried out so that the ribbon-like material is wound around the projectile leaving groove-like recesses between respective wound rotating band layers.

* * * * *